US011028639B2

(12) United States Patent
Ouyang et al.

(10) Patent No.: US 11,028,639 B2
(45) Date of Patent: Jun. 8, 2021

(54) LOW FRICTION HIGH SPEED ROLL DOOR AT HIGH WIND LOADS

(71) Applicant: OVERHEAD DOOR CORPORATION, Lewisville, TX (US)

(72) Inventors: Ruiping Ouyang, Richardson, TX (US); Sree Lakshmi Kanuri, Lewisville, TX (US); Toru Kimura, Plano, TX (US)

(73) Assignee: OVERHEAD DOOR CORPORATION, Lewisville, TX (US)

( * ) Notice: Subject to any disclaimer, the term of this patent is extended or adjusted under 35 U.S.C. 154(b) by 27 days.

(21) Appl. No.: 15/618,813

(22) Filed: Jun. 9, 2017

(65) Prior Publication Data

US 2017/0356239 A1 Dec. 14, 2017

Related U.S. Application Data

(60) Provisional application No. 62/348,654, filed on Jun. 10, 2016.

(51) Int. Cl.
*E06B 9/00* (2006.01)
*E06B 9/15* (2006.01)
(Continued)

(52) U.S. Cl.
CPC ..... *E06B 9/15* (2013.01); *E06B 9/13* (2013.01); *E06B 9/17046* (2013.01);
(Continued)

(58) Field of Classification Search
CPC ..... E06B 9/17046; E06B 9/86; E06B 9/58; E06B 9/581; E06B 2009/587; E06B 9/80; E06B 9/17076; E06B 9/13; E06B 2009/1566; E06B 2009/805; E06B 2009/135; E06B 2009/6836; E06B 2009/6818; E06B 2009/1577; E06B 2009/1583; E06B 2009/1588; E06B 2009/1594; E06B 9/15; E06B 2009/1505;
(Continued)

(56) References Cited

U.S. PATENT DOCUMENTS 2,886,102 A * 5/1959 Olsen ..... E05D 15/165 160/235
3,263,734 A * 8/1966 Lister ..... B61D 19/002 160/113

(Continued)

*Primary Examiner* — Daniel P Cahn
(74) *Attorney, Agent, or Firm* — Haynes and Boone, LLP

(57) ABSTRACT

A high speed roll door is movable between an open and a closed position at an opening of a building. The door includes a flexible curtain and a pair of side columns. Each side column provides an inner track to guide the curtain in vertical movement and restrain the curtain from lateral movement during deployment and retraction. The curtain further includes multiple cross bars supporting the flexible curtain from one of the pair of side columns to the other. Each of the cross bars further includes a first longitudinal bar sandwiching part of the curtain; and a second longitudinal bar pivotally connected to the first longitudinal bar. The hinge has an axis of rotation parallel to the first and the second longitudinal bars. At least a wheel is rotatably affixed to each end of the second longitudinal bar to engage the inner track of each of the side columns.

8 Claims, 6 Drawing Sheets

(51) Int. Cl.

| | |
|---|---|
| ***E06B 9/17*** | (2006.01) |
| ***E06B 9/58*** | (2006.01) |
| ***E06B 9/80*** | (2006.01) |
| ***E06B 9/13*** | (2006.01) |
| *E06B 9/68* | (2006.01) |

(52) U.S. Cl.
CPC ..... *E06B 9/17076* (2013.01); *E06B 9/581* (2013.01); *E06B 9/582* (2013.01); *E06B 9/80* (2013.01); *E06B 2009/135* (2013.01); *E06B 2009/1566* (2013.01); *E06B 2009/6818* (2013.01); *E06B 2009/6836* (2013.01); *E06B 2009/805* (2013.01)

(58) Field of Classification Search
CPC ..... E06B 2009/1516; E06B 2009/1533; E06B 2009/1538
See application file for complete search history.

(56) References Cited

U.S. PATENT DOCUMENTS 4,357,978 A * 11/1982 Keller ..... E06B 9/17046 160/271
5,056,579 A 10/1991 Krafutler
5,141,043 A 8/1992 Kraeutler
5,141,044 A * 8/1992 Hying ..... E06B 9/40 160/265
5,392,836 A 2/1995 West et al.
5,477,902 A 12/1995 Kraeutler
5,632,317 A * 5/1997 Krupke ..... E06B 9/13 160/264
5,682,937 A * 11/1997 Decrane ..... E06B 9/13 160/133
5,765,622 A 6/1998 Lichy
6,089,305 A * 7/2000 Gruben ..... E06B 9/13 160/264
6,152,208 A * 11/2000 Kalempa ..... E06B 7/2318 160/118
6,260,601 B1 7/2001 Thomas
7,159,637 B2 * 1/2007 Snyder ..... E06B 3/485 160/121.1
7,516,770 B2 * 4/2009 Jerry ..... E06B 9/13 160/267.1
7,775,252 B2 * 8/2010 Snyder ..... E01F 13/04 160/113
7,955,460 B2 * 6/2011 Bennett, III ..... E06B 3/485 156/78
8,037,921 B2 10/2011 Dondlinger et al.
8,607,842 B2 12/2013 Drifka
8,851,147 B2 10/2014 Drifka et al.
8,857,498 B2 10/2014 Dondlinger et al.
8,887,790 B2 11/2014 Drifka
9,127,501 B1 * 9/2015 Stobich ..... E06B 9/40
9,347,258 B2 * 5/2016 Dwarka ..... E06B 9/24
2003/0079845 A1 * 5/2003 Stern, Jr. ..... E06B 9/581 160/201
2005/0067116 A1 * 3/2005 Ceccofiglio ..... E06B 9/581 160/133
2007/0277941 A1 * 12/2007 Jansen ..... E06B 9/13 160/271
2007/0277943 A1 * 12/2007 Boerger ..... E06B 9/581 160/273.1
2008/0196842 A1 * 8/2008 Schoeren ..... E06B 9/581 160/133
2011/0253323 A1 * 10/2011 Bowman ..... E06B 9/17046 160/309
2012/0241109 A1 * 9/2012 Drifka ..... E06B 9/13 160/264
2012/0247692 A1 * 10/2012 Panseri ..... E06B 9/13 160/349.2
2013/0098566 A1 * 4/2013 Horvath ..... E06B 9/58 160/273.1
2013/0255893 A1 * 10/2013 Stobich ..... E06B 9/40 160/268.1
2013/0306252 A1 * 11/2013 Lambridis ..... E06B 9/13 160/133
2014/0190709 A1 * 7/2014 Stoebich ..... A62C 2/10 169/48
2014/0305600 A1 * 10/2014 Casey ..... E06B 9/581 160/127
2014/0345812 A1 * 11/2014 Casey ..... E06B 9/13 160/273.1
2015/0128502 A1 * 5/2015 Janick ..... E06B 9/17046 49/460
2016/0376841 A1 * 12/2016 Hentschel ..... E06B 9/581 160/270
2017/0009524 A1 * 1/2017 Dwarka ..... E06B 9/24
2017/0211315 A1 * 7/2017 Fleischman ..... E06B 9/17007

* cited by examiner

LOW FRICTION HIGH SPEED ROLL DOOR AT HIGH WIND LOADS

CROSS REFERENCE TO RELATED APPLICATION

This application is a United States Non-Provisional Patent Application which claims the benefit of and priority to U.S. Provisional Patent Application No. 62/348,654 filed Jun. 10, 2016.

TECHNICAL FIELD

This disclosure relates to high-speed roll up fabric barriers.

BACKGROUND

High speed roll doors are often used in industry environments that have high traffic, differences in atmospheric temperature and pressure, and high exterior wind conditions. For example, warehouses may employ high speed roll doors to allow forklifts to travel through air-conditioned sections of a building quickly while limiting wind, pressure, temperature, or noise disturbances.

High speed roll doors commonly include a flexible curtain made of a fabric or polymer material. The flexible curtain is often opaque but can include windows made of another transparent flexible material. Because of the flexible properties, the flexible curtain needs constraints at its perimeters. For example, a top roller defines the maximal height of the opening and provides source of motion to open and close the roll door; a bottom bar defines the actual height of the opening and provides a gravitational pull for keeping the flexible curtain taught; and two side columns constrains the side edges of the flexible curtain so that the curtain does not give in to wind loads or loads due to pressure differences.

When the flexible curtain is under high wind load or high pressure, the constraint of the side columns causes a reactive force perpendicular to the side columns. The reactive force can result in a high frictional force that prevents the normal operation of the roll door, such as to reduce the operation speed or even prevent the movement. This issue can occur both when the flexible curtain is completely deployed (i.e., the door is at closed position) or when the flexible curtain is partially deployed (i.e., the door is partially open).

SUMMARY

This disclosure relates to high-speed roll up fabric barriers that have reliable and efficient mechanisms to reduce movement friction and to secure the barriers at the closed position when loaded with normal forces in high winds.

In a first general aspect, a roll door is movable between an open position and a closed position. The roll door includes a flexible curtain having a pair of opposed side edges. Each side edge is configured to be inserted within a track member. At least one rigid cross-bar is secured to the flexible curtain. The cross-bar extends between the pair of opposed side edges of the flexible curtain. The cross-bar has opposed ends. There is at least one roller secured to each end of the cross-bar. The roller is positioned to move within the track member as the roll door is moved between the open and closed positions.

In some embodiments, the at least one cross bar further includes a first rigid bar pivotally connected to a second bar along an axis extending between the opposed side edges of the flexible curtain. The first rigid bar connects to a first section of the flexible curtain and the second rigid bar connects to a second section of the rigid bar.

In some other embodiments, the at least one rigid bar connects a first section of the flexible curtain to a second section of the flexible curtain.

In yet some other embodiments, the at least one cross bar further includes a wheel secured to each respective end of the cross-bar, the wheel movable within the track member.

In some embodiments, the roll door further includes a bottom bar secured to a bottommost portion of the flexible curtain. The bottom bar has a flexible tab extending from an end thereof and is configured to removably engage the track member.

In some other embodiments, the flexible tab further includes a stopper member secured thereto.

In yet some other embodiments, the roll door further includes a number of spherical members secured to each of the opposed side edges for engaging the track member.

In a second general aspect, a roll door movable between an open position and a closed position at an opening of a building structure includes a flexible curtain for shielding wind from entering the building structure. The flexible curtain has a pair of side edges. The flexible curtain is deployable from the open position to the closed position and retractable from the closed position to the open position. The flexible curtain further includes multiple spaced apart gliding spheres that are coupled to the flexible curtain at both side edges. The gliding spheres are disposed within the pair of side columns to support the flexible curtain and allow the curtain to travel at high wind loads under low frictional forces. The roll door also includes a pair of side columns providing guides and supports to the flexible curtain during deployment and retraction. A pair of lateral restrictors is also included. Each restrictor has a base member extending toward the flexible curtain for defining an inner allowable play in an entry direction of the roll door and an angled support member covering an end of the base member and forming a reception angle for receiving the plurality of spaced apart spheres when the flexible curtain is under front wind loads.

In some embodiments, the spaced apart gliding spheres are made from ultra-high-molecular-weight polyethylene.

In some other embodiments, each of the spaced apart gliding spheres is affixed onto the flexible curtain by means of assembly or by molding.

In some embodiments, each of the pair of side columns profiles a rectangular cross section bent from a set of metal sheets. The set of metal sheets forms an inner track for receiving the flexible curtain and the plurality of spaced apart gliding spheres at the side edges of the flexible curtain. Two bent metal sheets may further be included to form the column profile. Each metal sheet may have an end side, a front side, an entrance side, and a track side. The end sides of the two bent metal sheets are affixed to each other for forming the rectangular cross section.

In some other embodiments, a pair of brush liners is affixed at the inner track of each of the pair of side columns. Each of the pair of brush liners is angled toward and to contact the flexible curtain.

In a third general aspect, a roll door movable between an open position and a closed position at an opening of a building structure includes a flexible curtain shielding wind from entering the building structure. The flexible curtain includes a lower edge and a pair of parallel side columns each guiding and supporting the flexible curtain with a track during the flexible curtain's deployment and retraction. The pair of side columns has a distance less than a minimum width of the flexible curtain and its lower edge. The lower edge extends at each end a flexible tab into the tracks of the side columns. A drive assembly may be included and operable to deploy the flexible curtain from the open position to the closed position and to retract the flexible curtain from the closed position to the open position. A pair of lock plates each positioned at the floor and inside each of the pair of side columns near the track such that when the flexible curtain is lowered to the closed position, the flexible tab on each end of the lower edge slides into the corresponding lock plate, wherein the pair of lock plates constraining lateral movements of the flexible tabs such that the lower edge stays in place when the roll door is loaded with high wind pressures.

In some embodiments, each of the flexible tabs includes a flexible plate that bends elastically and allows the lower edge to be broken off from the tracks of the pair of side columns. The flexible tab further includes a pair of stoppers sandwiching the flexible plate to achieve a thickness variation to engage the lock plates, wherein the pair of stoppers are prevented from exiting the pair of side columns at the lock plates when the roll door is at the closed position. The pair of stoppers is made from ultra-high-molecular-weight polyethylene.

In some other embodiments, the door further includes an opening at an upper portion of each of the pair of side columns, wherein the opening allows the flexible tabs to reenter the tracks of the pair of side columns when the roll door is at the open position.

In some embodiments, the lower edge further includes an accelerometer for detecting the breaking off of the flexible tab and wirelessly sending the detection to a control unit.

In yet some other embodiments, the flexible tabs are made from ultra-high-molecular-weight polyethylene.

In a fourth general aspect, a roll door movable between an open position and a closed includes a pair of side channels for guiding a flexible curtain movable between the open and closed positions via a plurality of retention members. Each of the side channels has a back wall, an angular end wall, and a pair of sidewalls. Each of the plurality of retention members further includes a rectangular portion and a non-rectangular portion. The non-rectangular portion is operable to engage the angular end wall at an angle to prevent the retention members from passing through a space between a first of the pair of sidewalls and the angular end wall extending from a second of the pair of side walls, when the flexible curtain is under sufficient loads to pull the plurality of retention members from a neutral position at which the plurality of retention members is not in contact with the angular end wall of the side channels to a contact position at which the non-rectangular portion is pressed against the angular end wall.

DESCRIPTION OF THE FIGURES

Like elements are referenced with like numerals.

DETAILED DESCRIPTION

Figure 1:
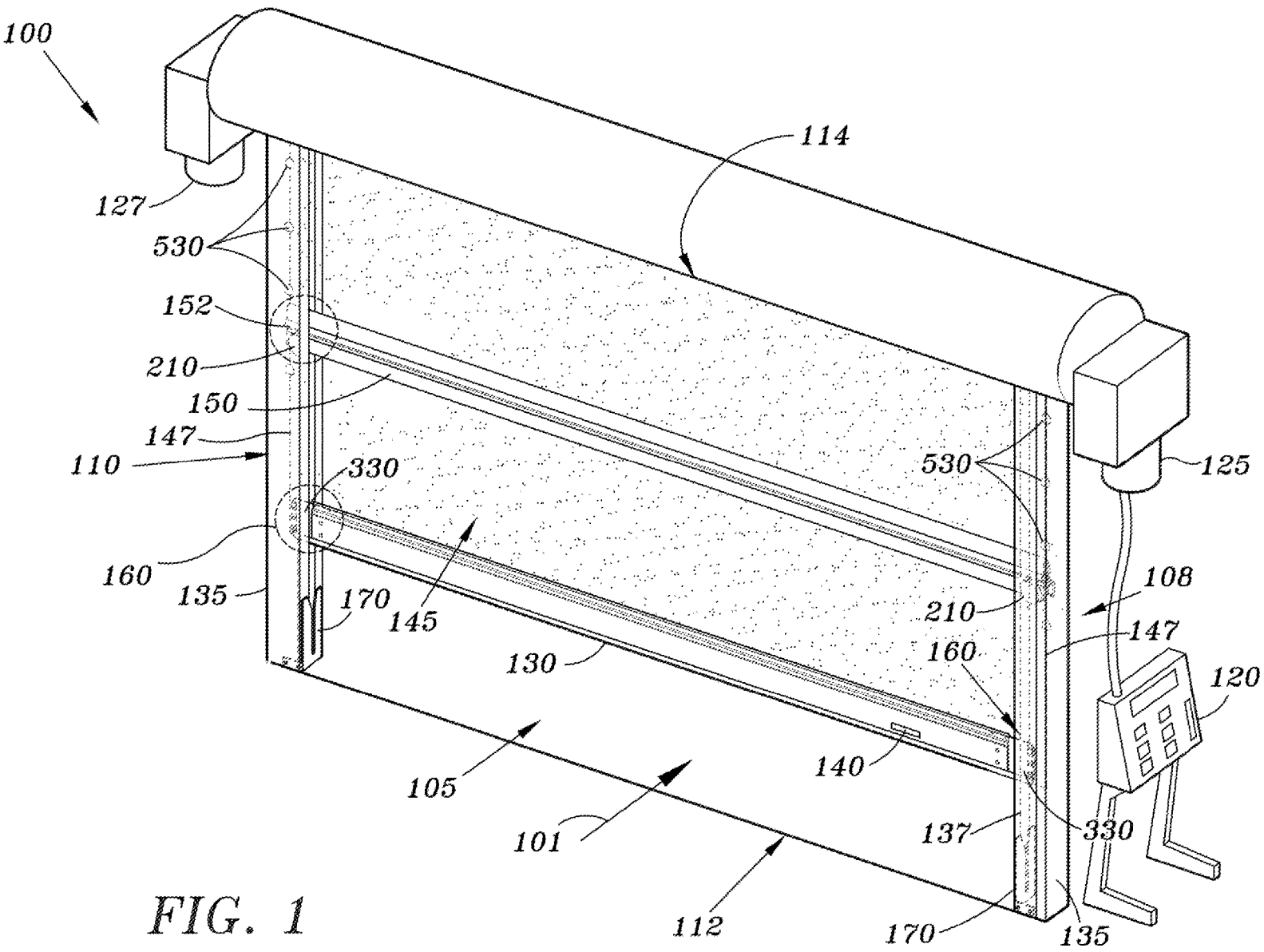
FIG. 1 is a perspective view of a first embodiment of a high speed roll door.

FIG. 1 is a perspective view of a high speed roll door 100 (hereinafter "roll door 100"). The roll door 100 is movable between an open position, to allow access or passage through a passageway 105 of a building structure, such as, for example, a loading dock or an area divider of a warehouse, and a closed position, to prevent access or passage through the passageway 105. As illustrated in FIG. 1, the passageway 105 is defined by a pair of jambs 108 and 110, a floor 112 and a header 114. In the embodiment illustrated in FIG. 1, the roll door 100 includes a flexible curtain 145 that winds onto and unwinds from a drum and is bound at each end by respective tracks 137 that are disposed within side columns 135. The flexible curtain 145 has a pair of side edges 147.

In operation, a drive assembly 125 moves the flexible curtain 145 between the open and closed positions. According to some embodiments, a second drive assembly 127 is used to operate concurrently with or as a backup to the drive assembly 125. In the embodiment illustrated in FIG. 1, the drive assembly 125 and the second drive assembly 127 are connected to a control terminal 120, which sends signals to control movement of the roll door 100.

Referring specifically to FIG. 1, the roll door 100 includes a bottom bar 130 coupled to the bottommost portion of the flexible curtain 145. As explained in greater detail below, the bottom bar 130 includes two ends 160 having flexible tab members 330 extending therefrom and into engagement with the tracks 137. The bottom bar 130, in some embodiments, includes a sensor 140 for monitoring the position or other condition of the bottom bar 130. For example, the sensor 140 may be used to detect an impact to the bottom bar 130 and in particular, whether the bottom bar 130 has detached from one or both of the tracks 137.

In operation, the bottom bar 130 extends laterally into the tracks 137 without significantly restricting and/or otherwise resisting the vertical movement of the flexible curtain 145. As discussed in greater detail below, when the roll door 100 is in the closed position, the ends 160, and in particular the flexible tabs 330 of the bottom bar 130, extend into and otherwise engage with the respective lock plates 170 disposed within the side columns 135. This engagement secures the flexible curtain 145 in the closed position and resists wind and other forces acting on the flexible curtain 145 potentially causing the bottom bar 130 from detaching from the tracks 137.

According to some embodiments, the flexible curtain 145 may include one or more cross-bars (or wind struts) 150, which support the flexible curtain 145 at spaced apart vertical intervals. As illustrated in FIG. 1, the cross-bars 150 extend laterally across the width of the flexible curtain 145 in a generally parallel and horizontal fashion, however, it should be understood that the cross-bars 150 may be otherwise oriented (e.g., in a non-parallel relationship and non-horizontal relationship). In the embodiment illustrated in FIG. 1, a single cross-bar 150 is illustrated; but more or fewer cross-bars may be utilized depending on the height of the curtain and the amount of reinforcement that is desired. In operation, the cross-bars 150 provide structural support for the flexible curtain 145 under wind loading conditions thereby acting to transfer the wind-loads acting on the door to the side columns 135, and thus, to the door jambs 108 and 110. As described in greater detail below, each of the cross-bars 150 includes an end 152 extending at least partially into the track 137.

Figure 2A:
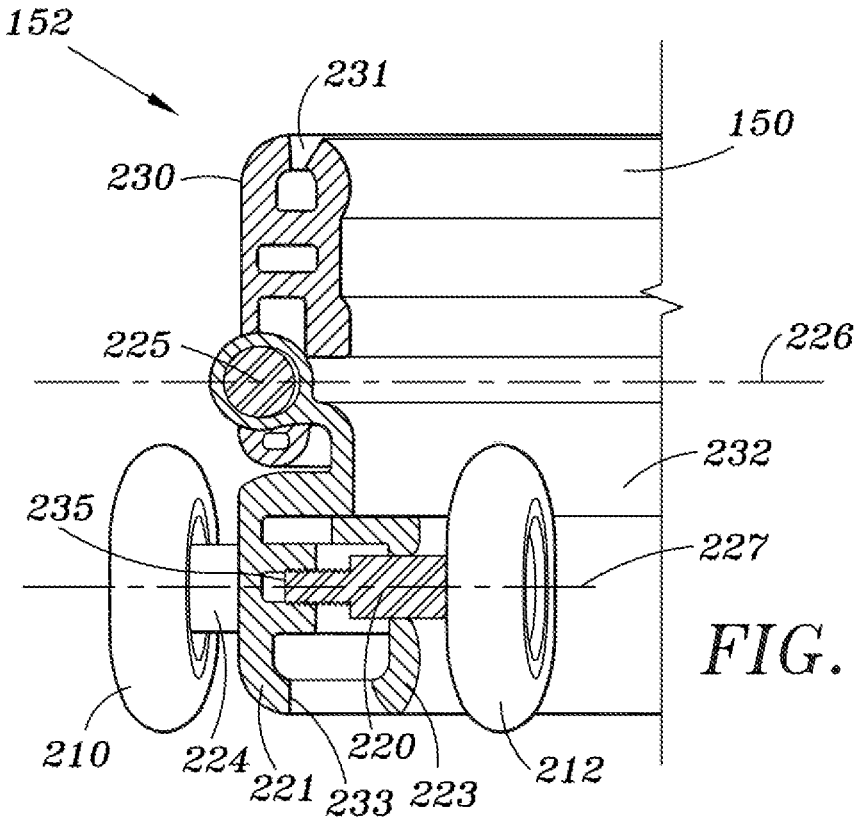
FIG. 2A is a perspective side view of an end of a wind strut for the roll door of FIG. 1.
Figure 2B:
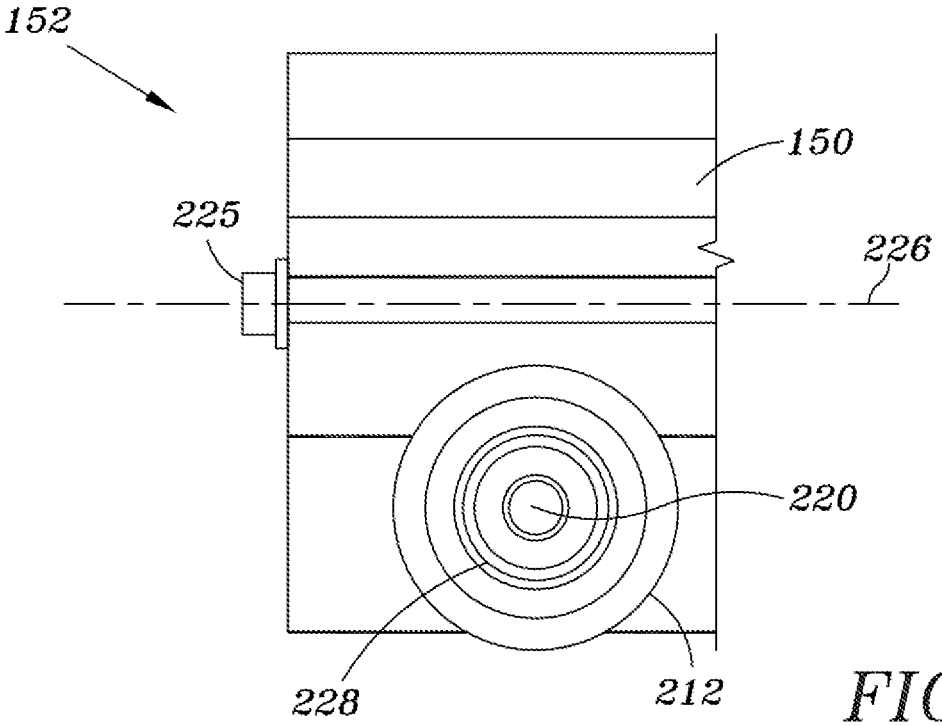
FIG. 2B is a local front view of the end of the wind strut of FIG. 2A.

Referring to the embodiment illustrated in FIGS. 2A and 2B, the cross-bar 150 is formed having a first longitudinal bar 230 with a slot 231 to receive and otherwise engage a portion of the flexible curtain 145 to secure the curtain to the cross-bar 150. The cross-bar 150 further includes a second longitudinal bar 232 pivotally connected to the first longitudinal bar 230 via a hinge 225. Similar to the first longitudinal bar 230, the second longitudinal bar 232 includes a slot 233 to receive and otherwise engage a portion of the flexible curtain 145 to secure the flexible curtain 145 to the cross-bar 150. The hinge 225 has an axis of rotation 226 parallel to the first and the second longitudinal bars 230 and 232 to facilitate rolling and unrolling of the flexible curtain 145 onto the drum when the flexible curtain 145 is moved between the open and closed positions.

According to some embodiments, a pair of wheels 210 and 212 is rotatably affixed to each end of the cross-bar 150, and in one embodiment, to the second longitudinal bar 232. In operation, the wheels 210 and 212 engage and are otherwise movable within the track 137 such that under high wind loads, the translational movement of the plurality of cross bars 150 will not encounter significant frictional increase while the flexible curtain 145 moves between the open and closed positions. Furthermore, the wheels 210 and 212 are sized so as to be secured and maintained within the track 137 even when high wind forces act against the flexible curtain 145.

The wheels 210 and 212 are supported on shafts 220 and 224 having bearings 228. The bearing 228 may be a rolling-element bearing, a journal bearing, or other types of bearings, such as a magnetic bearing. In some embodiments, the wheels 210 and 212 are coaxially aligned for providing balanced support while moving inside the track 137. In operation, the track 137 provides a vertical pathway to support wheels 210 and 212 for vertical movement while at the same time restraining the horizontal movement, deflection and possible separation of the cross-bars 150 from the track 137.

The second longitudinal bar 232 includes a back piece 221, which provides a first half support for the flexible curtain 145 and a receiving opening 235 aligned with a common axis 227. The wheels 210 and 212 are mounted concentric to the common axis 227. The second longitudinal bar 232 further includes a front piece 223 that is coupled to the back piece 221. The front piece 223 provides a second half support for the flexible curtain 145. The extended distance between the front piece 223 and the back piece 221 provides an increased stability to the shaft 220 to avoid substantial bending or rotation deformation under loads. As a result of the extended distance, the second longitudinal bar 232 has a greater thickness than the first longitudinal bar 230. The increased thickness further provides the cross-bar 150 an improved bending resistance for the width of the flexible curtain 145. The wheels 210 and 212 are positioned beyond the side edges 147 relative to the flexible curtain 145. Thus, when the flexible curtain 145 is rolled up, the wheels 210 and 212 do not interfere with the rolling operation.

Figure 3A:
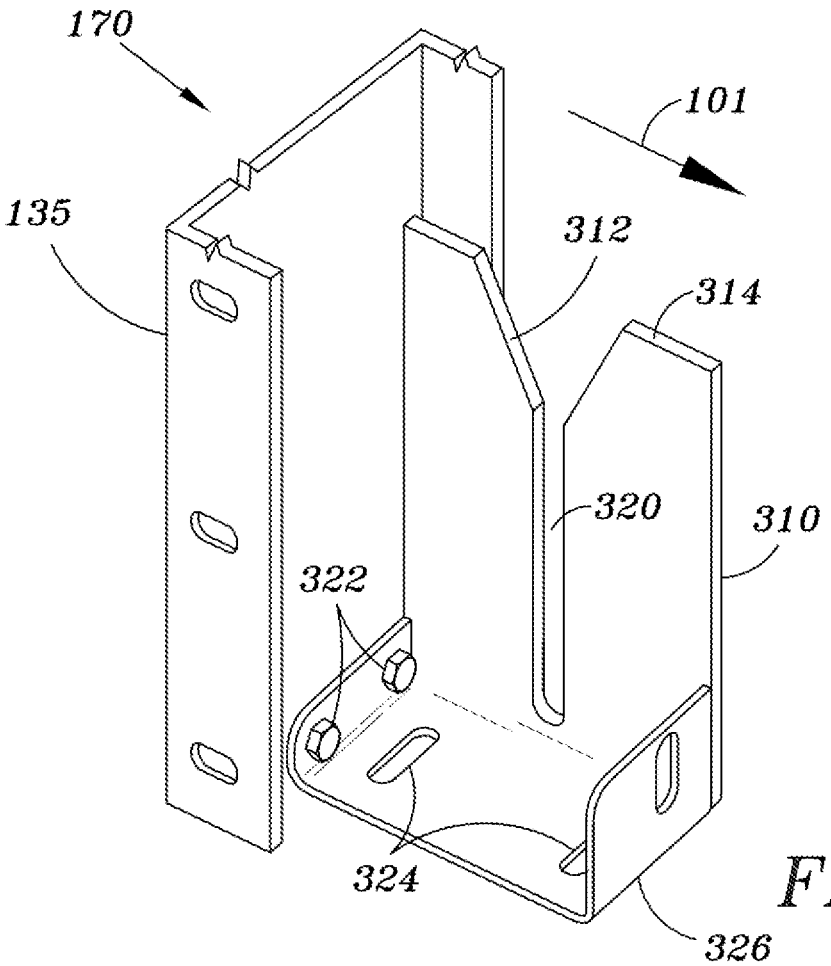
FIG. 3A is a perspective view of a lock plate installed in one of the side columns of the high speed roll door of FIG. 1.
Figure 3B:
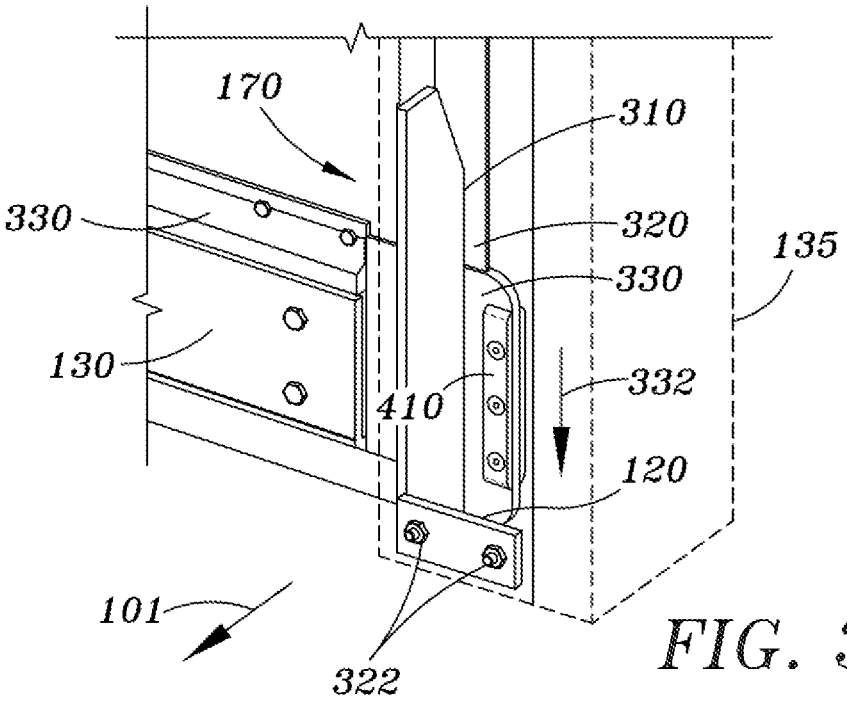
FIG. 3B is a perspective view of the lock plate holding the flexible curtain of the high speed roll door of FIG. 3A.

Referring specifically to FIGS. 1, 3A and 3B, the lock plate 170 is illustrated positioned at the floor 112 and inside the side column 135 near or otherwise adjacent the inner track 137 such that the flexible curtain 145, and in particular, the bottom bar 130, engages the lock plates 170 for resisting lateral movement when the roll door 100 is in the closed position (FIG. 3B). As illustrated, the lock plate 170 is disposed within the side column 135 and not inside or otherwise blocking the passageway formed by the door jambs 108 and 110 and the side columns 135. Thus, as vehicles, such as, for example, fork lifts, travel through the passageway 105, the lock plates do not obstruct the passageway 105 and potentially damage a vehicle or otherwise themselves damaged. In the embodiment illustrated in FIG. 3A, for example, the lock plate 170 includes a base section 326 and an upright section 310, both being sized to fit within the side column 135 so as to not block or otherwise obstruct the passageway 105 defined by the door jambs 108 and 110. According to some embodiments, the lock plate 170 may be made from a piece of sheet metal, such as steel.

In use, the lock plate 170 may be fastened to the side columns 135 by fasteners 322. Furthermore, in the embodiment illustrated in FIG. 3A, for example, the base section 326 includes openings 324 to enable the lock plate 170 to be fastened directly to the floor 112. Additional mounting openings can be provided to secure the lock plate 170 in place. In FIG. 3A, the upright section 310 is formed having a top edge 314 with guide chamfers 312 for guiding the bottom bar 130 into a receiving slot 320 when the flexible curtain 145 is lowered and positioned in the closed position. As discussed more fully below, when the roll door 100 is in the closed position 112, the bottom bar 130 contacts the ground and the flexible tab 330 extending from each end of the bottom bar 130 is positioned inside the receiving slot 320.

Figure 4A:
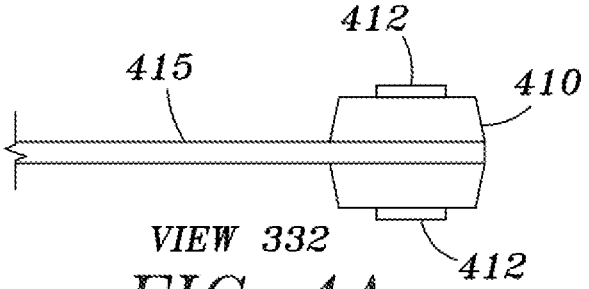
FIG. 4A is a top view of a flexible tab for engaging the lock plate of FIG. 3A.
Figure 4B:
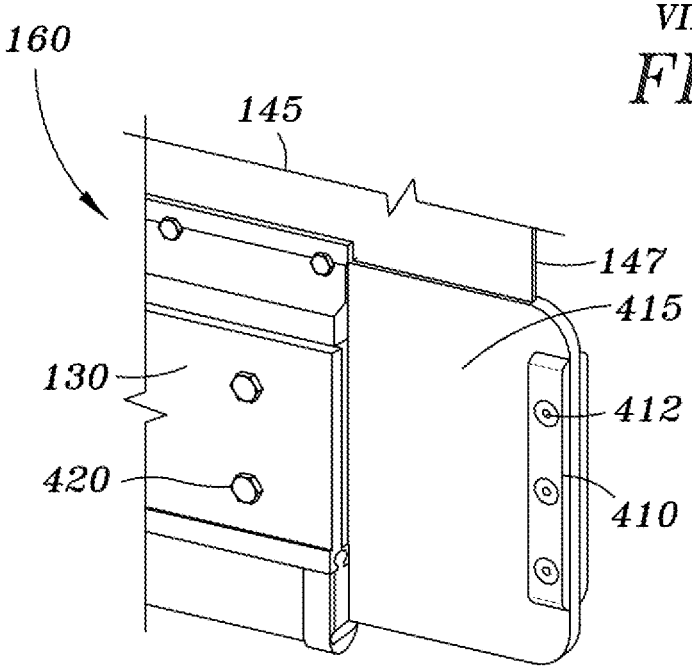
FIG. 4B is a perspective view of the flexible tab shown in FIG. 4A.
Figure 4C:
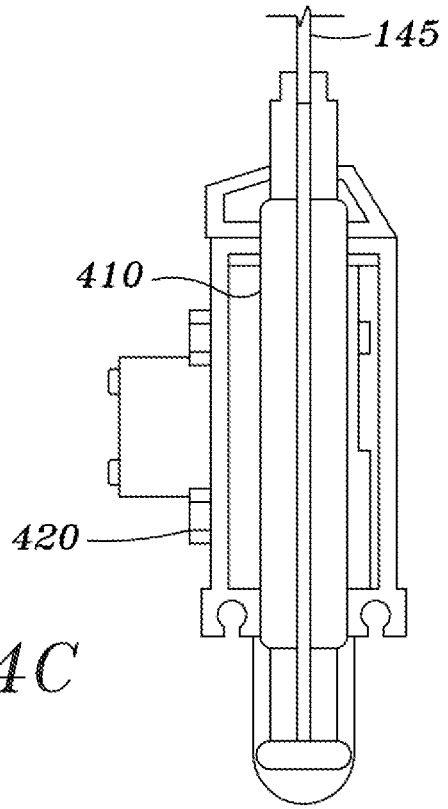
FIG. 4C is a side view of the flexible tab shown in FIGS. 4A-4B.

Referring now to FIGS. 4A through 4C, the flexible tab 330 is illustrated extending from the bottom bar 130. In the embodiment illustrated in FIG. 4A, the flexible tab 330 is sandwiched between a first portion and a second portion of the bottom bar 130 and is secured via a plurality of fasteners 420. However, it should be understood that the flexible tab 330 may otherwise be secured to the bottom bar 130. For example, the flexible tab 330 may be secured to a front or rear surface of the bottom bar 130 by any method of attachment (screws, glue, tape, etc.). Furthermore, while only one flexible tab 330 is illustrated extending from the end of the bottom bar 130, it should be understood that more than one flexible tab 330 may be utilized.

According to some embodiments, the flexible tab 330 may be made from any material that allows for substantial elastic bending. For example, according to one embodiment, the flexible tab 330 is formed of rubber or any other type of elastic polymer to enable deflection or bending thereof. Regardless of the material, the stiffness of the flexible tab 330 should be less than the stiffness of the bottom bar 130 so that the flexible tab 330 bends in lieu of the bottom bar 330 bending. Thus, for example, if a forklift impacts the roll door 100, the flexible tab 330 is able to deflect or otherwise bend to allow the bottom bar 130 to break away from the tracks 137 without damaging the tracks 137 or the bottom bar 130. When the bottom bar 130 breaks away, the flexible curtain 145 may fold along the cross bar 150 closest to the bottom bar 130, where the flexible curtain 145 is laterally restrained (e.g., by the wheels 210 and 220). In some other embodiments, the flexible curtain 145 may fold along a line where there is other lateral constraint closest to the bottom bar 130 (such as, for example, constraints by spheres 530 as discussed in FIGS. 5A and 5B).

According to some embodiments, a flexible tab 330 can include a stopper member 410, which, as explained in greater detail below, is sized to engage with the lock plate 170 to prevent the flexible tab 330 from separating from the track 137. With reference to FIGS. 3A and 3B, the stopper member 410 is positioned on the end of the flexible tab 330 opposite the bottom bar 130. As such, when the roll door 100 is in the closed position, as best illustrated in FIG. 3B, the stopper member 410 is disposed on the opposite side of the lock plate 170 from the flexible curtain 145. As such, when a wind force acting in the direction of arrow 101 acts on the roll door 100, the size of the stopper member 410 prevents the flexible tab 330 from traveling through the slot 320 (and thus separating from the track 137) due to the increased thickness of the stopper member 410 engaging the upright section 310 of the lock plate 170. As such, when the roll door 410 is in the closed position, the pair of lock plates 170, in conjunction with the flexible members 330, prevents the bottom bar 130 from separating from the tracks 137 due to high wind forces.

In some embodiments, the stopper members 410 sandwich and are otherwise disposed on both sides of the flexible tab 310 and are secured via a plurality of fasteners 412. In other embodiments, a stopper member 410 is secured to a single side of the flexible tab 310. In the alternative, the stopper members 410 can be formed integral with the flexible tab 310 and can be any shape or size. According to embodiments disclosed herein, the size of the stopper members 410 should be large enough to not travel through the slot 320 on the lock plate 170, but sized small enough to travel through and otherwise exit the tracks 137 so that, as explained above, the bottom bar 130 can break-away from the tracks 137 and thus, the side columns 135 in the event of contact by a vehicle.

According to some embodiments, the stopper members 410 may be made from ultra-high-molecular-weight polyethylene or other strong and light materials to engage the lock plate 170. In some embodiments, the flexible tab 330 may be made from ultra-high-molecular-weight polyethylene in one piece, for example, to mold the flexible tab 415, the stoppers 410 as one and removes the need to assemble. The stoppers 410 are removable such that in the event a stopper becomes damaged, they can be replaced without replacing the flexible tab 330.

Figure 5A:
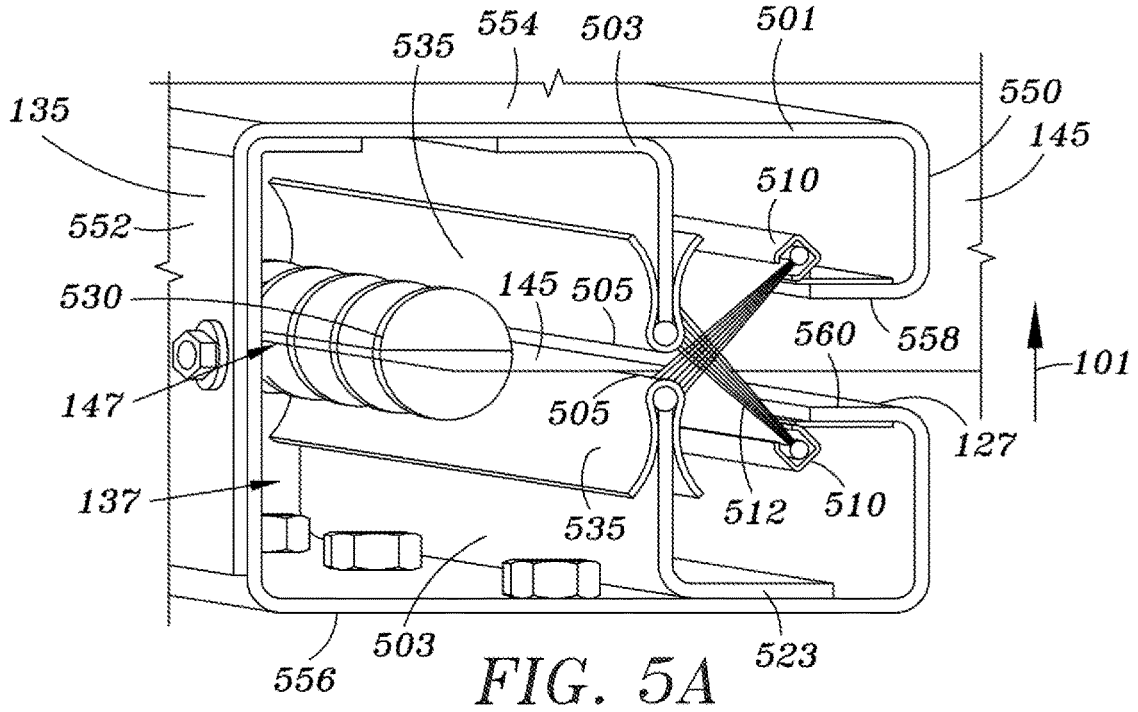
FIG. 5A is a perspective view of a second embodiment of a high speed roll door, showing local features inside one of the two side columns.
Figure 5B:
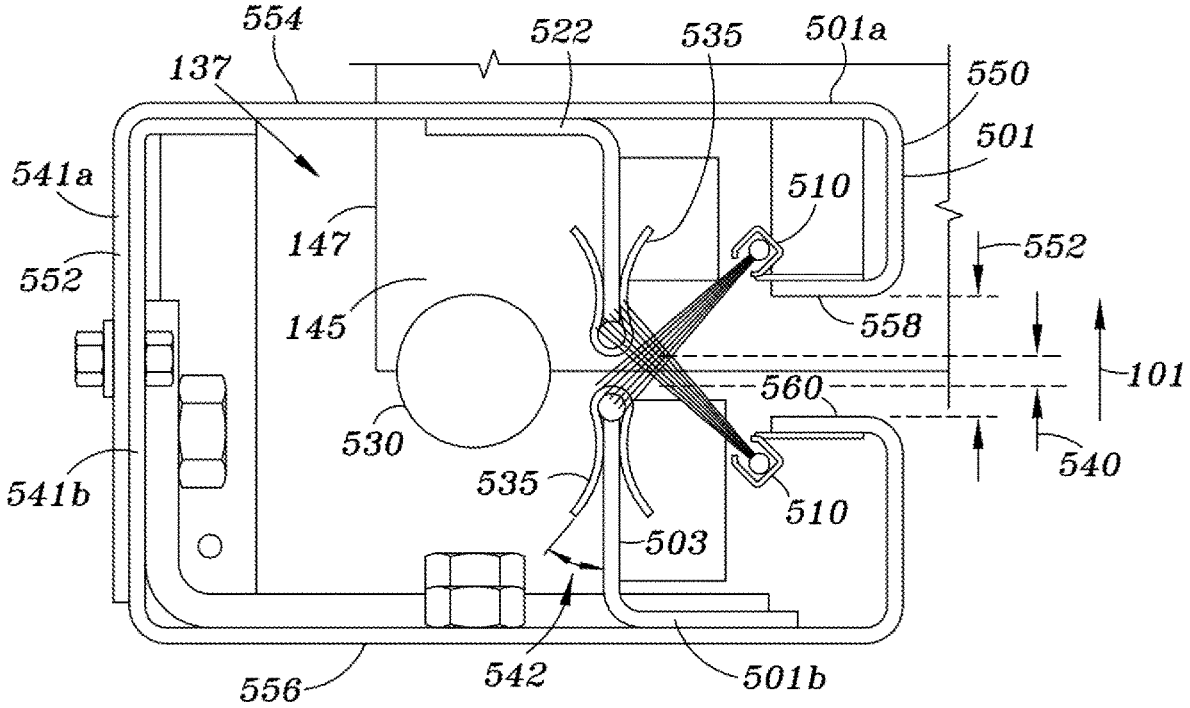
FIG. 5B is a top view of the local features shown in FIG. 5A.

Referring now to FIGS. 1, 5A and 5B, the flexible curtain 145 includes two side edges 505 extending inside the tracks 137. The flexible curtain 145 includes a plurality of spaced apart locking or spherical members 530 coupled to the flexible curtain 145 along the side edges 505 and are disposed within the tracks 137 to guide the flexible curtain 145 between the open and closed positions. According to some embodiments, the spaced apart locking members 530 are spherical in shape and are affixed onto the flexible curtain 145 by sandwiching the curtain between two half portions of the spheres 530. In other embodiments, however, the gliding spheres 530 may be integrally formed with the flexible curtain 145 or positioned on a single side of the flexible curtain 145 and further, can be any size or shape, so long as they can fit within and remain inside the track sections 137 when a force (wind or otherwise) is applied to the flexible curtain 145.

In operation, the spaced apart gliding spheres 530 support the flexible curtain 145 within the tracks 137 for movement of the flexible curtain 145 between the open and closed positions while also prevent separation of the flexible curtain 145 from the tracks 137 under high wind load conditions. Preferably, the spheres 530 are formed of a material having a low frictional coefficient so as to minimize frictional engagement between the spheres 530 and the tracks 137. In some embodiments, the gliding spheres 530 are made from ultra-high-molecular-weight polyethylene or other lightweight and durable material.

Referring specifically to FIGS. 5A and 5B, each side column 135 contains a rectangular cross sectional area and is formed having a front wall 550, a rear wall 552 and a pair of sidewalls 554 and 556. In some embodiments, the side columns 135 includes a pair of lateral restrictors 503 extending from the sidewalls 554 and 556 in order to, as explained in greater detail below, secure and maintain the gliding spheres 530 inside the track section 137 as the flexible panel 145 is positioned between the open and closed positions.

According to some embodiments, each of the pair of side columns 135 is formed having a rectangular cross section bent from a set of metal sheets 501. For example, the side column 135 includes a first section 501*a* bent at three locations to form a bracket having an end side 541*a*, and a second section 501*b*, bent at four locations to form a bracket having an end side 541*b*. In the embodiment illustrated in FIGS. 5A and 5B, the end sides 541*a* and 541*b* are bolted, welded, or otherwise affixed to each other to form the rectangular cross section. It should be understood that although the side column 135 is formed of two separate pieces 501*a* and 501*b*, the column may be otherwise formed. For example, the side column 135 may include more than two pieces 501 or a singular and uniform piece 501 bent or otherwise formed into a tubular rectangular shape with a track opening. Further, in other embodiments, the side column 135 may be formed with different cross sectional profiles, such as circular, triangular, elliptical or others.

According to the embodiment illustrated in FIGS. 5A and 5B, the front wall 550 includes a pair of inwardly turned opposed guide walls 558 and 560 forming a gap 552 to receive and guide the flexible curtain 145 therein. In addition, the opposed guide walls 558 and 560 support anchoring slots 510 for brush liners 512, which as further discussed below, are configured for sealing action.

Each lateral restrictor 503 includes extends from the sidewalls 554 and 556 a sufficient distance forming a gap 540 therebetween (FIG. 5B). In the embodiment illustrated in FIGS. 5A and 5B, each lateral restrictor 503 optionally includes an angled support member 535 covering an end of the restrictor 503 so as to protect the flexible curtain 145 from repetitive wear and potentially damaging contact between the end of the restrictor 503 and the flexible curtain 145. In addition, the angled support members 535 allow the spherical members 530 to more easily slideingly travel within the track 137. According to embodiments disclosed herein, the angled support members 535 are formed of a plastic material so as to avoid damage to the flexible curtain 145 and reducing the frictional forces between the spherical members 530 and the restrictors 503 to facilitate the movement of the flexible curtain 145 between the open and closed positions.

Referring specifically to FIG. 5B, each angled support member 535 forms a reception angle 542 for receiving the plurality of spaced apart spheres 530 when the flexible curtain 145 is under front wind loads such that the spheres 530 are pulled toward and in contact with the support members 535. In the current example, the reception angle 542 is an arc function forming a curved cross section. In other embodiments, the reception angle 542 may have a constant numerical value. The reception angle 542 may have a significant impact on the ability for the spheres 530 to reduce friction when they are in contact with the support member 535. For example, an optimum contact area size may be achieved by specific profile selected for the reception angle 542 and the materials used in the spheres 530 and the support member 535.

Referring to FIGS. 5A and 5B, the brush liners 512 are affixed at slots 510 and are angled toward and to contact the flexible curtain 145. In operation, the brush liners 512 seal the spaced apart spheres 530 from dirt or other contaminants that could enter the inner track 137. The brush liners 512 may also provide a barrier for noise and serve as a guide for the flexible curtain 145 to move between the open and the closed positions.

Figure 6:
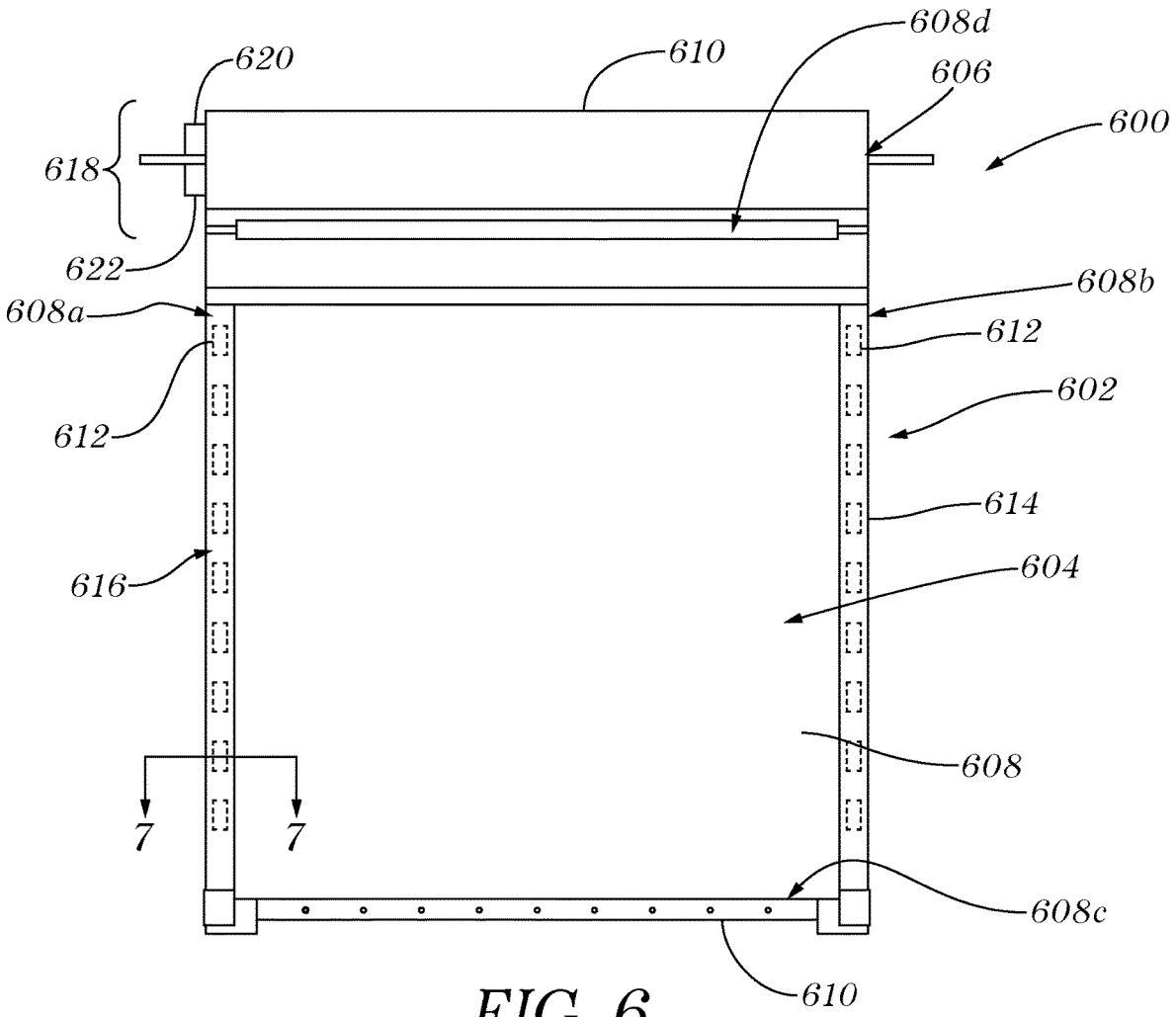
FIG. 6 is a front view of another embodiment of a high speed roll door.
Figure 7:
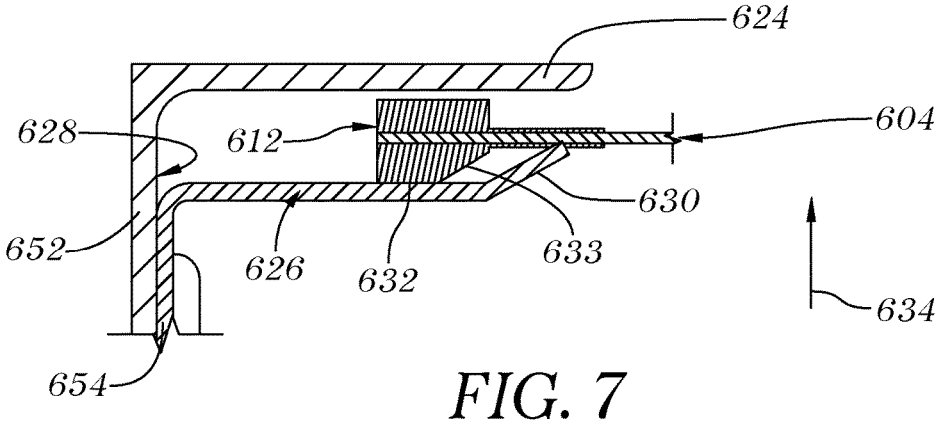
FIG. 7 is a section view of the track in FIG. 6 taken along the line 7-7.

FIGS. 6-7 illustrate another embodiment of a high speed roll door 600. The high speed roll door 600 includes a door frame 602 and a flexible door or curtain 604 that is movable along the door frame 602 between an open position and a closed position. While in the open position, the door 604 is at least partially rolled onto a drum 606. Likewise, when the door 604 is in the closed position, the door 604 covers the door opening to prevent access therethrough. The door 604 is formed of any flexible material, such as for example, a rubber, plastic or fabric material and is defined by a pair of side edges 608*a*, 608*b*, a bottom edge 608*c* and a top edge 608*d*. In the embodiment illustrated in FIG. 6, the top edge 608*d* is secured to the drum 606, a bottom bar 610 is secured to the bottom edge 608*c*, and a plurality of spaced apart retention members 612 are secured on or generally adjacent to the side edges 608*a* and 608*b*, as illustrated in FIG. 9 and as explained in greater detail below.

In the embodiment illustrated in FIGS. 6-7, the door fame 602 includes a right side channel 614, a left side channel 616, and an overhead transverse member 618 that extends between the upper ends of the right and left side channels 614 and 616. In the embodiment illustrated in FIG. 6, the transverse member 618 houses and/or otherwise supports the drum 620 and a motor 622 for positioning the door 604 between the open and closed positions.

In the embodiment illustrated in FIG. 6, the door 604 generally rectangular in shape and is slightly wider than a distance between the right and left side channels 614 and 616 so that the main body 608, and in particular, the side edges 608*a* and 608*b*, extends at least partially inside the right and left side channels 614 and 616.

FIG. 7 is a cross sectional view of the side channel 616 taken along the line 7-7 of FIG. 6. It should be understood that the side channel 614 is formed having the same configuration; thus, for simplicity, discussion will be limited to the side channel 616. As illustrated, the channel 616 includes two parallel and spaced apart side walls 624 and 626 that are oriented generally parallel to the door 604. The side wall 624 is supported by the back wall 628, which together forms a first right angle piece 652. The side wall 626 further includes a back wall 654 and an angular end wall 630, the angular end wall 630 extending to prevent and/or otherwise resist the retention members 612 from exiting the side channels 616 due to lateral forces acting on the door 604 (i.e., wind, unwanted contact on the door, etc.). In particular, end wall 630 angularly extends from the end of the wall 626 to reduce the gap in which the curtain extends through to prevent or otherwise resist movement of the retention members 612 from exiting the side channel 616. According to some embodiments, the components of the side channel 616, such as the right angle piece 652 and angle piece 654, are formed from materials of a high rigidity to withstand designed wind and other loads without being plastically deformed and otherwise damaged.

According to embodiments disclosed herein, the retention members 612 are formed having a first member 630 and a second member 632 that attach together and are otherwise secured to respective opposite sides of the door 604. In FIG. 7, the member 630 contains a generally rectangular cross section and the second member 632 includes a sloped or angular portion 633 having a surface that is sloped at an angle to correspond to the slope of the angular end wall 630. Thus, as explained in greater detail below, during movement of the door 604 between the open and closed positions, the angular portion 633 slideably abuts against the angular end wall 630.

According to some embodiments, each of the members 630, 632 are secured together via at least one fastener, such as, for example, a threaded screw, that extends through the door 604 and engages threads in a corresponding threaded interior opening in the member 630 and/or 632. In other embodiments, each member 630 and 632 can be secured directly to each side of the door 604 via an adhesive or otherwise. According to embodiments disclosed herein, a plurality of retention members 612 are coupled in an aligned, spaced-apart relationship along the right and left side edges 608*a* and 608*b* of the main body door 604 to guide and retain the door 604 within the door frame 602, as schematically illustrated in FIG. 6. The retention members 612 may be made of any type of rigid material such as a rubber, plastic, or a metal material. In use, if the door 604 receives an impact in the direction of arrow 634 (FIG. 7), for example, the retention members 612 engage the right and left side channels 614 and 616 to retain the door 604 within the door frame 602.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes some embodiments of the disclosure, and alterations, modifications, additions and/or changes can be made thereto without departing from the scope and spirit of the disclosed embodiments, the embodiments being illustrative and not restrictive.

Furthermore, the disclosure is not to be limited to the illustrated implementations, but on the contrary, is intended to cover various modifications and equivalent arrangements included within the spirit and scope of the disclosure. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A roll door movable between an open position and a closed position, the roll door comprising:

a flexible curtain having a pair of opposed side edges, each side edge of the pair of opposed side edges configured to be inserted within a track member;

at least one cross-bar secured to the flexible curtain, the at least one cross-bar extending between the pair of opposed side edges, the at least one cross-bar having opposed first and second ends, wherein the at least one cross-bar includes a hinge rotatably connecting a first longitudinal bar of the at least one cross-bar and a second longitudinal bar of the at least one cross-bar, the first longitudinal bar securing a first portion of the flexible curtain, the second longitudinal bar securing a second portion of the flexible curtain, the second portion separated from the first portion, wherein the first longitudinal bar secures the first portion of the flexible curtain at a first slot and the second longitudinal bar secures the second portion of the flexible curtain at a second slot, the second slot formed between a front piece of the second longitudinal bar and a back piece of the second longitudinal bar; and at least one roller secured to each of the opposed first and second ends of the at least one cross-bar and positioned to move along inside the track member as the roll door is moved between the open position and the closed position, wherein a shaft of the at least one roller is secured to a back piece of the first longitudinal bar or the back piece of the second longitudinal bar of the at least one cross-bar.

2. The roll door of claim 1, wherein the shaft of the at least one roller is secured to the back piece and passes through the front piece of the second longitudinal bar, the front piece of the second longitudinal bar insertable into the back piece of the second longitudinal bar.

3. The roll door of claim 1, further comprising a bottom bar secured to a bottommost portion of the flexible curtain, the bottom bar having a flexible tab extending from the bottom bar and configured to removably engage the track member.

4. The roll door of claim 3, wherein the flexible tab further includes a stopper member secured thereto.

5. The roll door of claim 1, wherein the at least one roller is rotatably mounted on the shaft.

6. The roll door of claim 5, wherein the at least one roller is rotatably mounted on the shaft using a bearing.

7. A roll door assembly having a flexible curtain movable between an open position, to allow passage through a passageway, and a closed position, to prevent passage through the passageway, the assembly comprising:

a pair of side columns each having a track disposed therein to receive a respective side edge of the flexible curtain;

a bottom bar secured to a lower edge of the flexible curtain;

at least one cross-bar secured to the flexible curtain and extending between the side edges of the flexible curtain, the at least one cross-bar having opposed ends, the at least one cross-bar securing a first portion of the flexible curtain and a second portion of the flexible curtain, the second portion separated from the first portion;

at least one lock plate disposed inside one of the pair of side columns, the at least one lock plate having a slot to receive at least a portion of the bottom bar when the flexible curtain is in the closed position to prevent the bottom bar, and thus the flexible curtain, from detaching from the pair of side columns; and at least one roller secured to each of the opposed ends of the at least one cross-bar and positioned to move along inside the track in each of the pair of side columns as the flexible curtain is moved between the open and the closed positions, wherein each of the at least one roller is rotatable on a shaft removably fastened onto an end of the at least one cross bar.

8. The roll door assembly of claim 7, wherein the at least one cross-bar comprises a first longitudinal bar, a second longitudinal bar, and a hinge rotatably connecting the first longitudinal bar and the second longitudinal bar.

* * * * *